United States Patent [19]

Galumbeck

[11] Patent Number: 4,742,586

[45] Date of Patent: May 10, 1988

[54] ELEVATION SYSTEM FOR A BED ASSEMBLY

[76] Inventor: Michael H. Galumbeck, 5577 Vantage Point Rd., Columbia, Md. 21044

[21] Appl. No.: 31,221

[22] Filed: Mar. 27, 1987

Related U.S. Application Data

[63] Continuation of Ser. No. 802,053, Nov. 25, 1985, abandoned.

[51] Int. Cl.[4] ..... A61G 7/00

[52] U.S. Cl. ..... 5/72; 5/66; 5/79; 5/465; 5/411

[58] Field of Search ..... 5/465, 66, 67, 68, 70, 5/71, 72, 79, 433, 260, 411, 499

[56] References Cited

U.S. PATENT DOCUMENTS

| | | | |
|---|---|---|---|
| 559,242 | 4/1896 | Wicks | 5/66 |
| 595,913 | 12/1897 | Hale | 5/260 |
| 1,554,098 | 9/1925 | Kaiserman | 5/465 |
| 1,559,119 | 10/1925 | Miller | 5/411 |
| 1,581,994 | 4/1926 | Duncan | 5/66 X |
| 1,842,873 | 1/1932 | Leeking | 5/411 |
| 2,247,667 | 7/1941 | Rosberger | 5/499 |
| 2,279,286 | 4/1942 | Bell | 5/72 |
| 2,552,128 | 5/1951 | Waxman | 5/465 |
| 3,281,141 | 10/1966 | Smiley et al. | 5/69 X |
| 3,636,573 | 1/1972 | Bartz | 5/68 |
| 3,644,946 | 2/1972 | Swatt | 5/68 |
| 4,095,296 | 6/1978 | Ferro | 5/465 |
| 4,188,677 | 2/1980 | Zur | 5/66 |
| 4,258,445 | 3/1981 | Zur | 5/66 |
| 4,349,924 | 9/1982 | Zur | 5/68 |
| 4,361,917 | 12/1982 | Wilson | 5/68 |
| 4,527,298 | 7/1985 | Moulton | 5/66 |

FOREIGN PATENT DOCUMENTS

| | | | |
|---|---|---|---|
| 2433516 | 1/1976 | Fed. Rep. of Germany | 5/66 |
| 645110 | 9/1962 | Italy | 5/66 |
| 426238 | of 0000 | Switzerland | 5/465 |
| 247408 | 3/1947 | Switzerland | 5/465 |
| 2431 | of 1871 | United Kingdom | 5/66 |

*Primary Examiner*—Alexander Grosz

*Attorney, Agent, or Firm*—Sixbey, Friedman & Leedom

[57] ABSTRACT

A system for elevating the head portion of a bed assembly defined by a mattress and a box spring foundation, including a double pivot hinge secured to the border wires on either side of the mattress, a double linkage hinge secured to the upper border wire on either side of the foundation, a plurality of strap assemblies connecting the foundation to the mattress for maintaining the mattress in its position of alignment on the foundation, and an elevating mechanism for jointly raising and lowering the corresponding head portions of the mattress and foundation.

21 Claims, 3 Drawing Sheets

ELEVATION SYSTEM FOR A BED ASSEMBLY

This application is a continuation of application Ser. No. 802,053, filed 11/25/85, now abandoned.

BACKGROUND OF THE INVENTION

1. Field of the Invention

The present invention generally involves the field of technology pertaining to a bed assembly defined by a mattress and a foundation. More particularly, the invention relates to an improved system for elevating or pivoting corresponding portions of a mattress and foundation.

2. Description of the Prior Art

The concept of providing a bed wherein portions of the bed may be bent at various angles for the purpose of conforming the support surface defined by the bed to different desired angular positions of the human body is well known. A bed of this type has heretofore found greatest utility in hospital or other institutional patient care facilities wherein the patient must spend a great deal of time in bed and therefore requires that the bed be adjustable in contour in order to accommodate different bodily positions during the waking hours. For example, it is desirable to at least elevate the head portion of the bed to permit the patient to read, watch television or partake of meals. It is further desirous to elevate or angle the lower portion of the bed for raising the legs of the patient for providing an angled support beneath the knees. The structural considerations required for the manufacture of beds of this type are quite complex and expensive to implement. Therefore, beds provided with elevatable or adjustable features have generally been confined to the medical and institutional markets rather than the retail consumer market.

The construction of a bed having at least an elevatable head portion requires several important considerations. First, the mattress must be provided with a suitable hinge construction which will permit pivoting of the head portion of the mattress to the desired elevated position without disturbing the otherwise uniform support afforded by the mattress, whether in its elevated or flat position. Second, the foundation must also be provided with an appropriate hinge construction which permits the corresponding head portion of the foundation to be jointly elevated with the head portion of the mattress in order to provide full underlying support for the mattress in both the elevated and flat positions. Third, the elevating of corresponding overlying portions of the mattress and foundation results in a foreshortening of the foundation due to the substantial thicknesses of the two members, thereby tending to cause the mattress to slide or shift out of its initial flat position of alignment on the foundation. This latter situation therefore requires that some means be provided for restraining the mattress in its position of alignment on the foundation. Fourth, the elevation procedure itself should be accomplished through a mechanism which is smooth, quiet and reliable in operation, and of sufficient compactness so as to be unobtrusively concealed within the foundation when it is not being utilized.

Some examples of prior art teachings believed to be representative of the state of the art with respect to various devices and mechanisms relating to elevatable bed structures and the aforediscussed considerations are disclosed by the U.S. Pat. Nos. 888,303 to Bowers, 1,384,600 to Coil, 1,559,119 to Miller, 3,099,843 to Simon, 3,135,971 to Haller and 3,520,030 to Hawkins.

SUMMARY OF THE INVENTION

It is an object of the invention to provide an improved system for pivoting or elevating corresponding portions of a bed assembly defined by a mattress and foundation.

It is another object of the invention to provide an improved bed assembly having an elevatable head portion for supporting the user in an extremely comfortable position for reading, watching television or other activity.

It is a further object of the invention to provide a bed elevation system which is smooth, quiet and reliable in operation, and of such compactness as to be concealable within the bed structure when it is not being utilized.

It is yet another object of the invention to provide an improved hinge structure for a mattress which permits the bending of the mattress while retaining its structural integrity.

It is yet a further object of the invention to provide an improved hinge structure for a foundation which permits the bending of the foundation while retaining its structural integrity.

It is yet a further object of the invention to provide an improved restraining means for maintaining a mattress in its position of alignment on a foundation, whether the mattress is in an elevated or flat position.

It is still another object of the invention to provide an improved mechanism for elevating the corresponding head portions of a mattress and foundation.

The foregoing and other objects of the invention are realized through an improved bed elevation system which is defined by a combination of several features. The mattress is provided with a pair of opposed hinges, each of which is capable of a double pivot action and includes a pair of resilient members which attach directly to the existing border wires of the mattress and provide full support for the corresponding edge portions of the mattress. The foundation is provided with a pair of opposed hinge structures which are attached to the upper border wire of the foundation and is capable of being disposed in a compressed position and an extended position, the latter position serving to define a continuation of the border wire and providing full edge support of the foundation at their corresponding locations. The bottom of the foundation is provided with at least two spaced transverse hinges which permit a contoured bending of the foundation during the elevation of its head portion. The mattress is restrained from moving out of its position of alignment with respect to the foundation by a plurality of strap assemblies, each of which includes a strap having one end attached directly to a junction of the foundation wire grid and the other end being detachably secured to a corresponding loop carried by the mattress. The corresponding head portions of the mattress and foundation are jointly raised and lowered by an elevating mechanism which is carried by the foundation and includes a rotatable threaded rod on which a correspondingly threaded bracket is carried, with the bracket being attached to the underside of the foundation head portion by a yoke and transverse pull bar, whereby rotation of the rod in either direction causes linear movement of the bracket in a corresponding direction to raise or lower the corresponding head portions of the mattress and foundation.

Other objects, advantages and features of the invention shall become apparent from the following detailed description of the preferred embodiments thereof, with reference being made to the accompanying drawings wherein like reference characters refer to corresponding parts of the several views.

BRIEF DESRIPTION OF THE DRAWINGS

DETAILED DESCRIPTION OF THE PREFERRED EMBODIMENTS

Figure 1:
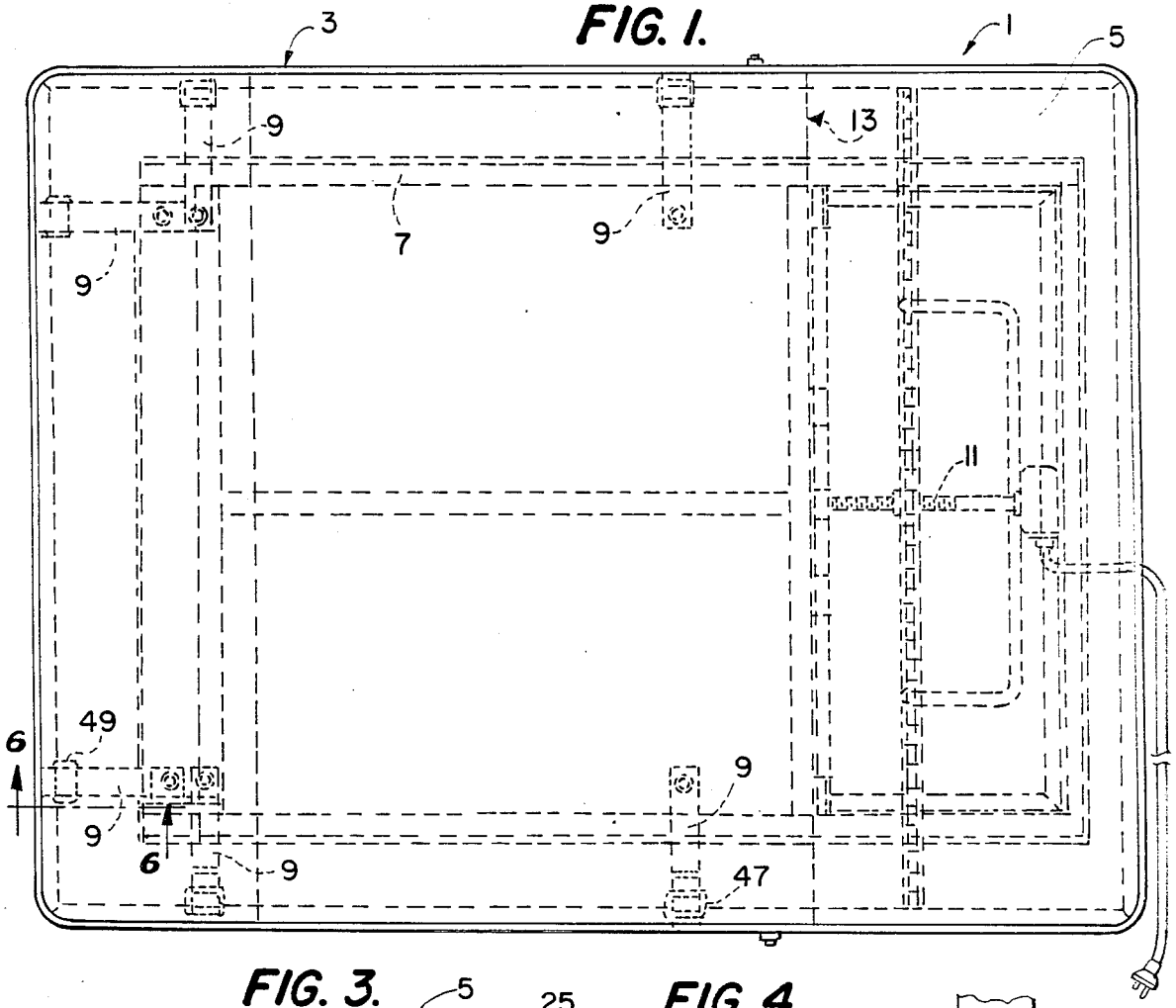
FIG. 1 is a plan view of a bed assembly defined by a mattress and a box spring foundation, and incorporating the elevation system of the present invention in accordance with a preferred embodiment thereof.

A bed elevation system 1, in accordance with a preferred embodiment of the invention, is generally shown in FIG. 1 incorporated within a bed assembly 3 that is basically defined by a mattress 5 supported on a box spring foundation 7.

Mattress 5 is secured in its position of alignment on foundation 7 by a plurality of strap assemblies 9. The corresponding head portions of mattress 5 and foundation 7 are jointly raised and lowered by an elevating mechanism 11 about a common hinge line, shown generally at 13, that extends transversely across bed assembly 1. As apparent, hinge line 13 basically defines a joint bending area for corresponding portions of mattress 5 and foundation 7. The structural details of each strap assembly 9, elevating mechanism 11 and the internal structures of both mattress 5 and foundation 7 which permit same to be jointly pivoted about common hinge line 13 shall hereinafter be described with reference to remaining FIGS. 2–9.

Figure 2:
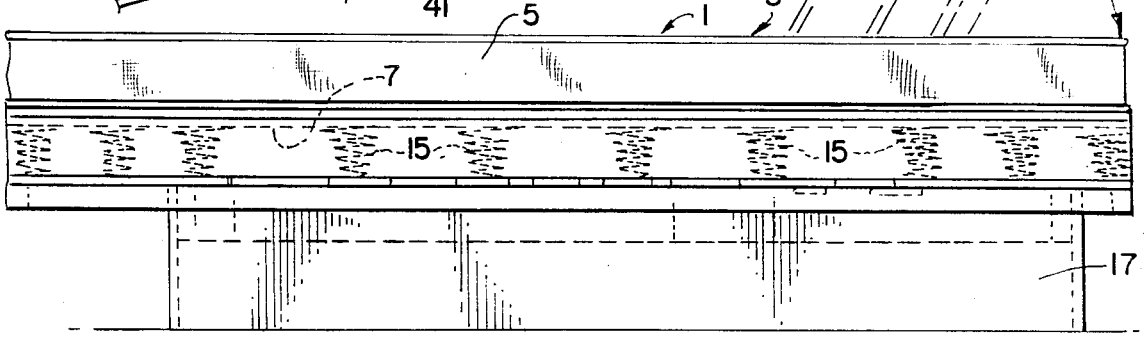
FIG. 2 is a side elevational view of the bed assembly of FIG. 1, showing the head portion of the bed, including corresponding head portions of the mattress and foundation, in an elevated position, as depicted in phantom lines.

As shown in FIG. 2, mattress 5 overlies foundation 7, with the latter being partially defined by a plurality of spaced internal coil springs 15 of conventional design. Bed assembly 3 may be supported in an elevated position on a base 17 or other appropriate support well known in the art. As shown in phantom lines, a mattress head portion 19 and corresponding foundation head portion 21 are capable of being raised and lowered in the opposite directions indicated by double arrow A between the fully elevated and flat positions shown. Head portions 19 and 21 are substantially of the same size, whereby the joint pivoting of same about common hinge line 13 necessarily causes a foreshortening of head portion 21 with respect to overlying head portion 19, as clearly shown in FIG. 2. This foreshortening results from the substantial thicknesses of head portions 19 and 21, and also if the remaining portion of mattress 5 is not permitted to shift from its position of alignment on the remaining portion of foundation 7. As shall hereinafter be rendered apparent, elevation system 1 permits a smooth and contoured elevation of head portions 19 and 21 in order to provide optimal comfort and support for the user of bed assembly 3 in a manner not previously realized through conventional technology.

Figure 3:
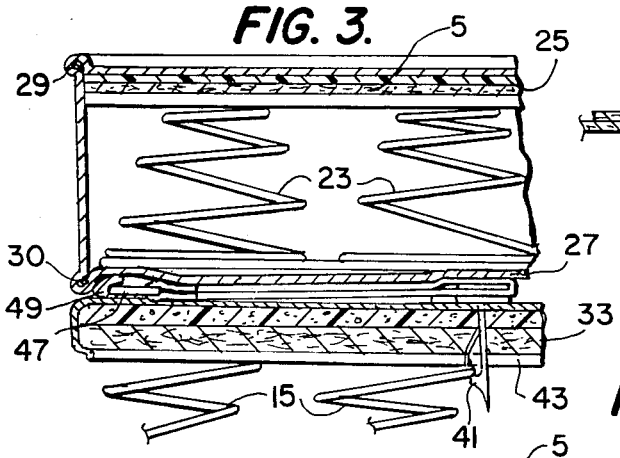
FIG. 3 is an enlarged fragmentary vertical sectional view taken on the line 3—3 of FIG. 1 and depicting a strap assembly for maintaining the mattress in its position of alignment on the foundation.
Figure 4:
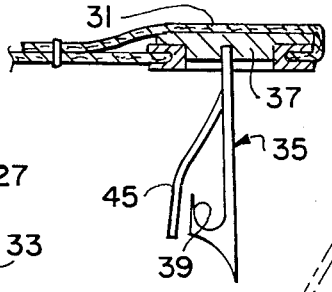
FIG. 4 is a further enlarged vertical sectional view depicting a preferred means for anchoring the strap assembly of FIG. 3 to a grid wire junction of the foundation.
Figure 4:
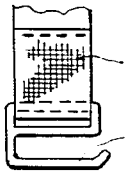
Figure 4A:
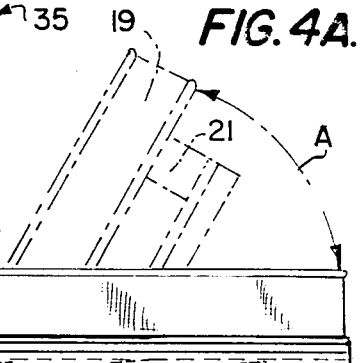
FIG. 4A is a sectional view showing the free end of a strap forming the strap assembly of FIG. 3 with a buckle attached thereto for detachable connection to a corresponding loop carried by the mattress.

The details of strap assembly 9 shall now be described with reference to FIGS. 3, 4 and 4A. Mattress 5 is shown provided with a plurality of spaced internal coil springs 23 disposed between an upper layer 25 and a lower layer 27, the structural characteristics of which may comprise any standard construction known in the art. The upper and lower peripheral edges of mattress 5 include an upper border wire 29 and a lower border wire 30. Each strap assembly 9 includes an elongate strap 31 formed from an appropriate fabric material and securely attached to an upper layer 33 of foundation 7. This is accomplished by means of a locking member 35 that includes a head portion 37 secured to one end of strap 31 and a hook portion 39 which is inserted through upper layer 33 and engages a grid wire junction 41 defined by coil spring 15 and a wire grid 43 of foundation 7. A guard 45 may be carried by locking member 35 to prevent dislodgement of grid wire junction 41 therefrom. As apparent, this arrangement serves to securely lock one end of strap 31 to foundation 7 and prevents its removal therefrom. The other end of strap 31 is provided with a hook buckle 47 of any appropriate design for detachably securing strap 31 to a corresponding fabric loop 49 that is attached to the peripheral edge of mattress 5, preferably by sewing loop 49 onto border wire 30. The engagement of buckle 47 to loop 49 is more clearly shown in FIG. 1, wherein there is also depicted a preferred orientation of plural strap assemblies 9. In this case, two pairs of assemblies 9 are each disposed at right angles at the foot of bed assembly 3, while two individual strap assemblies 9 extend transversely from the opposite sides of bed assembly 3 adjacent common hinge line 13. Through this configuration, mattress 5 cannot be shifted from its position of alignment on foundation 7, notwithstanding the simultaneous joint elevation of mattress head portion 19 and foundation head portion 21, and the foreshortening of head portion 21, in the manner shown in FIG. 2. The construction of strap assembly 9 as herein described affords considerable strength for its intended function and prevents any damage to the conventional fabric materials forming either lower layer 27 of mattress 5 or upper layer 33 of foundation 7. The fabric material forming strap 31 and its corresponding loop 49 may be of any well known in the art, including those formed from synthetic or natural fibers. The manner in which strap 31 and loop 49 may be sewn or constructed, and the manner in which locking member 35 is attached to strap 31 may be in accordance with any procedure well known in the art and deemed suitable for the practice of the invention as disclosed herein.

Figure 5:
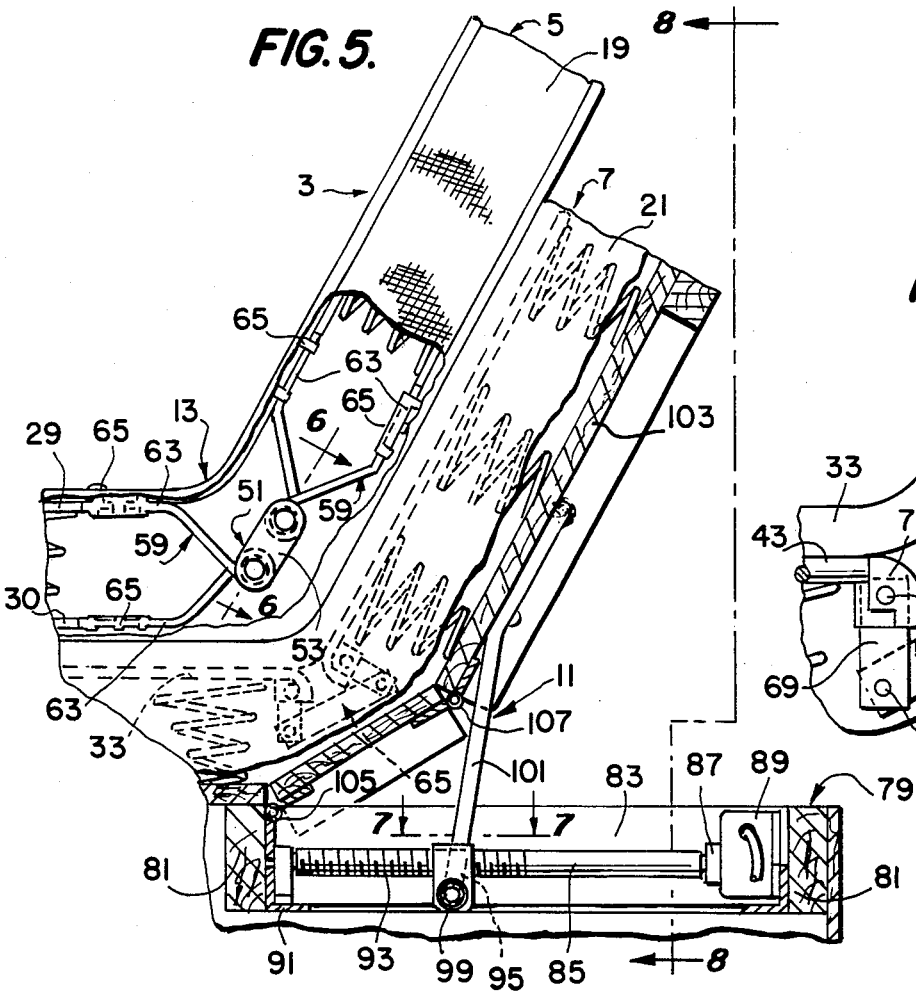
FIG. 5 is an enlarged fragmentary vertical sectional view showing the head portion of the bed assembly in its elevated position.

The internal structures of mattress 5 and foundation 7 which permit their respective head portions 19 and 21 to jointly pivot about common hinge line 13 shall now be described with initial reference to FIG. 5. As shown therein, mattress 5 is provided with a double pivot hinge 51 on opposite sides thereof. Though only one hinge 51 is shown, the structure and function of both hinges 51 are exactly the same. Each hinge 51 includes a central portion defined by a pair of opposed plates 53 secured together in a spaced disposition by a pair of circular-shaped spacers 55 and a pair of rivets 57 which lock plates 53 to spacers 55 in the manner shown in Fig. 6. The central axes of spacers 55 serve to define parallel double pivot axes which are perpendicular to the planes of plates 53. Hinge 51 further includes a pair of resilient members 59, each of which is preferably formed from a single length of spring wire provided with a central twist loop 61 therein and a pair of parallel legs 63. Each twist loop 61 is wrapped around a corresponding spacer 55, whereby legs 63 extend outwardly therefrom and are attached to corresponding upper and lower border wires 29 and 30 of mattress 5 by means of clamps 65 of any appropriate design. Twist loops 61 are free to rotate about their respective spacers 55, and thereby provide a double pivot action at the central portion of hinge 51. Because of the resilient nature of each member 59 and the presence of twist loop 61 therein, it is further apparent that parallel legs 63 are compressible against spring tension. This serves to provide the same resilient support for the edge of mattress 5 that is normally provided by border wires 29 and 30 when mattress 5 is disposed in its flat position. During the raising of head portion 19 into the position shown in Fig. 5, hinge 51 affords a smooth and contoured bending of mattress 5 about common hinge line 13, while maintaining full resilient edge support of mattress 5 on both sides thereof and preventing premature wear or damage to upper layers 25 and 27.

Figure 5A:
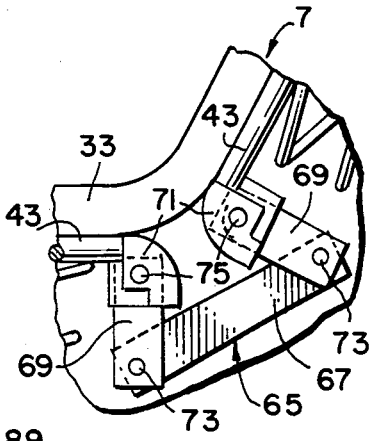
FIG. 5A is an enlarged fragmentary side elevational view, similar to FIG. 5, showing the hinge structure carried by the upper border wire of the foundation in its compressed position.
Figure 6:
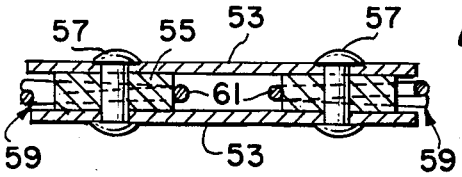
FIG. 6 is an enlarged horizontal sectional view through the hinge structure on one side of the mattress, taken on the line 6—6 of FIG. 5.
Figure 5C:
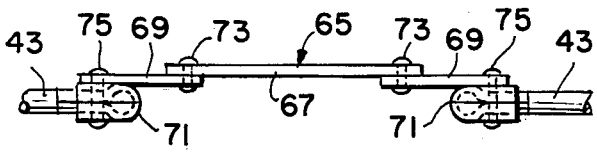
FIG. 5C is a fragmentary plan view taken on the line 5C—5C of FIG. 5B.
Figure 5D:
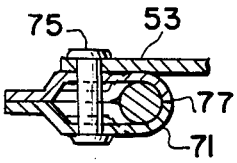
FIG. 5D is an enlarged fragmentary horizontal sectional view, taken on the line 5D—5D of FIG. 5B.
Figure 5B:
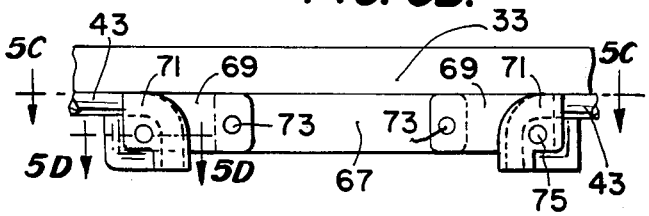
FIG. 5B is a fragmentary side elevational view, showing the hinge structure of FIG. 5A in its extended position.

The internal structure of foundation 7 which permits head portion 21 thereof to bend about common hinge line 13 shall now be described with reference to FIG. 5, and particularly to FIGS. 5A–5D. As depicted therein, the upper portion of foundation 7 is provided with a double linkage hinge 65 on opposite sides thereof in the vicinity of common hinge line 13 and disposed substantially directly below corresponding hinges 51 of mattress 5. Though only one hinge 65 is shown, the structure and function of both hinges 65 are exactly the same. As seen in FIG. 5A, hinge 65 includes an elongate central link 67, a pair of elongate pivot links 69, and a pair of right angle sockets 71. One end of each pivot link 69 is pivotally connected to a corresponding end of central link 67 by a rivet 73 or similar fastener. The other end of each pivot link 69 is pivotally connected to a corresponding right angle socket 71 by a rivet 75 or similar fastener. As further shown, border wire 43 of foundation 7 at common hinge line 13 is severed and provided with downturned ends 77, each of which is secured within a corresponding socket 71. This is more clearly shown in FIG. 5D. When head portion 21 of foundation 7 is brought to the elevated position shown in FIG. 5, hinge 65 is disposed in the compressed condition shown in FIG. 5A, which condition is made possible by virtue of the double pairs of pivot points defined by rivets 73 and 75. When head portion 21 is lowered to position foundation 7 back in its normal flat position, hinge 65 is then disposed in an extended position, as shown in FIGS. 5B and 5C. In this latter position, central link 67 and pivot links 69 are disposed in linear alignment with border wire 43. As such, hinge 65 provides a structural continuation of border wire 43 to define continuous support for the opposed upper edge portions of foundation 7 in the vicinity of common hinge line 13. Accordingly, full perimeter edge support of foundation 7 is maintained when the latter is disposed in its flat position.

Figure 7:
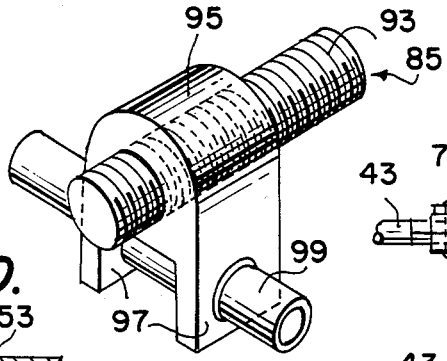
FIG. 7 is a fragmentary isometric view of the threaded rod forming a part of the elevating mechanism shown with the threaded bracket thereon, and taken on the line 7—7 of FIG. 5.

The details of elevating mechanism 11 shall now be described with particular reference to FIGS. 5, 7, 8 and 9. As initially seen in FIG. 5, mechanism 11 is incorporated within foundation 7 and secured to a wooden framework 79 forming the lower portion of foundation 7. Frame work 79 may be conventionally constructed from a plurality of transverse and longitudinal two-by-four wooden strips 81 and 83, respectively, secured together in any appropriate manner. Because the height of frame-work 79 is limited to the maximum width of each two-by-four, it is therefore important that elevating mechanism 11 is of such configuration so as to be capable of being fully accommodated within framework 79 when head portion 21 is in its lowermost position. This accommodation is made possible by the novel structural arrangement of mechanism 11. As shown, mechanism 11 includes a rod 85 that is connected at one end through an appropriate journal bearing 87 to the output of an electric motor 89. The other end of rod 85 is secured in an opposite journal bearing 91 which is attached to framework 79. Operation of motor 89 causes rod 85 to rotate within its respective bearings 87 and 91. An appropriate manually operated reversing mechanism and switch assembly (not shown) is provided for motor 89 to permit its ON and OFF operation, and also rotation of rod 85 in either direction. Rod 85 is provided with a threaded portion 93 along the length thereof and a bracket 95 provided with a corresponding internal threading, wherein bracket 95 is threadedly secured to threaded portion 93 of rod 85 for linear travel therealong. The preferred configuration of bracket 95 is shown in FIG. 7 wherein bracket 95 includes a pair of downwardly extending leg portions 97 through which an elongate bar 99 is rotatably journaled. As depicted in FIG. 5, bar 99 is connected to the lower portion of a yoke 101, with the upper end of yoke 101 being secured to a bottom layer 103 of foundation 7. Bottom layer 103 is provided with at least two spaced transverse hinges 105 and 107 which are disposed beneath hinges 65. It is preferred that bottom layer 103 be defined by plural sections of wood or other suitable material disposed for pivotal movement in substantially the same direction when elevated by elevating mechanism 11. Because at least two transverse hinges 105 and 107 are provided, a very gentle contoured bend of a concave configuration at the vicinity of hinge line 13 is realized when head portion 21 is raised to its elevated position. In this way, the sharp angled bend normally created by conventional elevating mechanisms is entirely avoided. As apparent from FIG. 5, operation of motor 89 causes bracket 95 to move linearly back and forth across threaded portion 93 of rod 85, thus raising or lowering head portion 21 of foundation 7 and associated head portion 19 of mattress 5. When head portions 19 and 21 are disposed in their lowermost positions, bracket 95 is disposed towards the lefthand side of rod 85, when viewed in FIG. 5, and yoke 101 is entirely concealed below bottom layer 103 and within framework 79.

Figure 8:
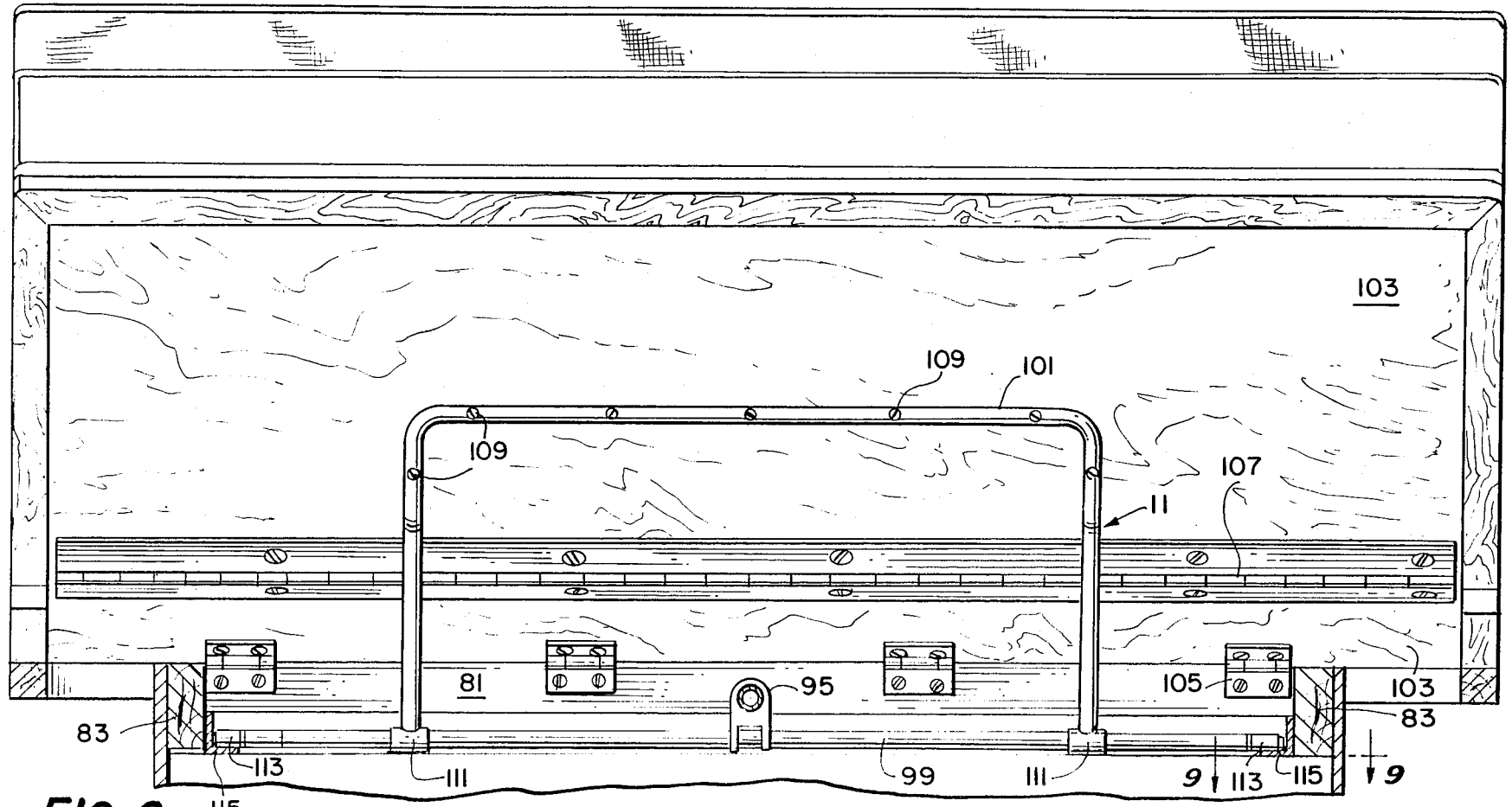
FIG. 8 is an elevational view, partly in section, taken on the line 8—8 of FIG. 5.
Figure 9:
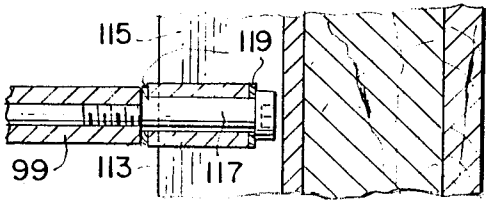
FIG. 9 is an enlarged fragmentary horizontal sectional view, taken on the line 9—9 of FIG. 8.

The details of bar 99 and yoke 101 shall be described with reference to FIGS. 8 and 9. As seen, yoke 101 is preferably of a U-shaped configuration, wherein the base portion thereof is secured to bottom layer 103 of foundation 7 by a plurality of screws 109 or similar mechanical fasteners. The leg portions of yoke 101 are angled slightly outwardly, as more clearly shown in FIG. 5, with each terminating in a transverse socket 111 through which bar 91 is rotatably received. The outer ends of the bar 99 are each provided with a roller 113, wherein each roller 113 is disposed in rolling engagement with an elongate track surface defined by an inwardly directed leg of a right angle flange 115. As seen in FIG. 9, each roller 113 is preferably a cylindrical member formed of appropriate material and rotatably secured to its corresponding end of bar 99 by means of a bolt 117 and a pair of opposed washers 119. Through this arrangement, linear movement of bracket 95 along threaded portion 93 of rod 85 causes corresponding rolling engagement of bar 99 along flanges 115. Depending on the direction of rotation of rod 85, head portions 19 and 21 are caused to be either raised towards their uppermost position or lowered to their flat position. It is of course understood that head portions 19 and 21 may also be disposed in any intermediate position of elevation, as determined by the position of bracket 95 on threaded portion 93 of rod 85.

It is to be understood that the forms of the invention herein shown and described are to be taken as merely preferred embodiments of the same and that various changes in shape, material, size and arrangement of parts may be resorted to without departing from the spirit of the invention or scope of the subjoined claims.

I claim:

1. An adjustable bed unit for elevating the end section of a mattress which extends outwardly beyond a first end of an elongate foundation support beneath the mattress from the plane of the remainder of the mattress supported by a support surface of said foundation support which extends in a first plane, said elevation occurring about spaced axes transverse to the longitudinal axis of said mattress to create and maintain an area of said end section adjacent to the juncture of the end section with the remainder of the mattress in a smooth, substantially concave arcuately curved configuration comprising a housing means having a first housing end and a second opposed housing end spaced therefrom, said housing means being configured to fit beneath the end section of said mattress with said first housing end adjacent to the first end of said elongated foundation support, a pivoted end assembly means connected to said housing means to extend in a second plane substantially parallel to said first plane when said housing means is positioned beneath said end section of said mattress, said pivoted end assembly means including an intermediate section having a first section end pivotally connected by a first pivot means to said housing means at said first housing end and a second section end opposite to said first section end, and a head section having a third section end pivotally connected by a second pivot means to said second section end and a free section end spaced therefrom, and elevating means mounted on said housing means within the confines thereof and connected to said pivoted end assembly means for simultaneously moving said intermediate and head sections in the same direction toward or away from said second plane with said free section end being maintained furthermost from said second plane when said end assembly means is moved from said second plane, said elevating means being operable upon initiation of said simultaneous movement of the head and intermediate sections to pivot said intermediate section about said first pivot means and to pivot said head section about said second pivot means to create a first angle between said intermediate section and said second plane and a second angle between said intermediate section and said head section, said elevating means including a unitary rigid yoke means for moving said pivoted end assembly toward and away from said second plane, said rigid yoke means including a first yoke section secured to said pivoted end assembly and a second yoke section extending at a fixed angle to said first yoke section from said first yoke section to a terminal end portion, and drive means connected to said terminal end portion and operative to move said terminal end portion along a path between said first and second housing ends.

2. The adjustable bed unit of claim 1, wherein said elevating means is positioned entirely beneath said end assembly means.

3. The adjustable bed unit of claim 2, wherein said drive means operates to move said terminal end portion between a first end of said path and a second end spaced from said first end, the angle between said first and second yoke sections being formed to cause said yoke means to move said end assembly means into the second plane when said terminal end portion is moved to the first end of said path, said housing means including spaced sidewalls extending between said first and second housing ends to define an upper open end for said housing means, said end assembly means operating to extend across and close said open end when said end assembly means is in the second plane.

4. The adjustable bed unit of claim 2, wherein said drive means includes a threaded drive rod extending between said first and second housing ends in substantially parallel relationship with the longitudinal axis of said mattress and mounted for rotation relative thereto, motive means mounted on said housing means and connected to rotate said drive rod in either direction, and a bracket threadedly engaged on said threaded drive rod for linear movement therealong in either direction corresponding to the direction of rod rotation, and connector means connecting said bracket to said terminal end portion of the second yoke section.

5. The adjustable bed unit of claim 4, wherein said housing means includes spaced sidewalls extending between said first and second housing ends, said connector means extending transversely of said drive rod outwardly from said bracket toward the sidewalls of said housing means, said second yoke section including spaced elongate legs connected to said connector means on either side of said bracket.

6. The adjustable bed unit of claim 5, wherein elongate track means are mounted upon said housing means to extend substantially parallel to said drive rod, said connector means including an elongate bar rotatably journaled through said bracket, the ends of said bar being retained by said elongate track means for movement along said elongate track means.

7. The adjustable bed unit of claim 1, wherein said elevating means simultaneously moves said head and intermediate sections to a plurality of angular positions between a first position in the second plane and a second position above the second plane, the relative angles between said intermediate section and the second plane and said head section and the intermediate section being greater than ninety degrees in all said angular positions.

8. The adjustable bed unit of claim 1, wherein said drive means operates to move said terminal end portion between a first end of said path adjacent to said first housing end and a second end of said path spaced from said first path end, the angle between said first and second yoke sections being formed to cause said yoke means to move said end assembly means into said second plane when said terminal end portion is moved to the first end of said path.

9. The adjustable bed unit of claim 8, wherein said intermediate section includes a first rigid base means, said first pivot means being connected between said first rigid base means and said housing means, and said head section including a second rigid base means, said second pivot means being connected between said second rigid base means and said first rigid base means, and resilient body means having upper support surface means spaced above said first and second rigid base means and resilient means extending between said first and second rigid base means and said upper support surface.

10. The adjustable bed unit of claim 9, wherein said first and second rigid base means are substantially equal in width, said second rigid base means being longer than said first rigid base means, and the distance between said first and second housing ends is no greater than one third of the length of said mattress.

11. The adjustable bed unit of claim 8, wherein said drive means includes a threaded drive rod extending between said first and second housing ends and mounted for rotation relative thereto, motive means mounted on said housing means and connected to rotate said drive rod in either direction, and a bracket threadedly engaged on said threaded drive rod for linear movement therealong in either direction corresponding to the direction of rod rotation, and connector means connecting said bracket to said terminal end portion of the second yoke section.

12. The adjustable bed unit of claim 11, wherein said housing means includes spaced sidewalls extending between said first and second housing ends, said connector means extending transversely of said drive rod outwardly from said bracket toward the sidewalls of said housing means, said second yoke section including spaced elongate legs connected to said connector means on either side of said bracket.

13. The adjustable bed unit of claim 12, wherein elongate guide means are mounted upon said housing means to extend substantially parallel to said drive rod, said connector means including an elongate bar rotatably journaled through said bracket, said bar being connected to said elongate guide means for movement along said elongate guide means.

14. The adjustable bed of claim 13, wherein said first and second housing ends and said spaced sidewalls define an upper open end for said housing means, said first pivot means being connected to said housing means adjacent to said upper open end and said intermediate and head sections operating to extend across and close said open end when said pivoted end assembly means extends in said second plane.

15. The adjustable bed unit of claim 1, wherein said intermediate section includes a first rigid base means, said first pivot means being connected between said first rigid base means and said housing means, and said head section includes a second rigid base means, said second pivot means being connected between said second rigid base means and said first rigid base means, said housing means being unitary with said elongate foundation support.

16. The adjustable bed unit of claim 15, wherein said elevating means is positioned entirely beneath said first and second rigid base means.

17. The adjustable bed unit of claim 16, wherein said drive means operates to move said terminal end portion between a first end of said path and a second end spaced from said first end, the angle between said first and second yoke sections being formed to cause said yoke means to move said end assembly means into the second plane when said terminal end portion is moved to the first end of said path, said first yoke section being secured to said head section.

18. The adjustable bed unit of claim 15, wherein said first and second rigid base means are substantially equal in width to said foundation support, said second rigid base means being longer than said first rigid base means, said first and second rigid base means having a combined length which is no more than one-third the length of said foundation support.

19. The adjustable bed unit of claim 1, wherein said housing means in unitary with said elongate foundation support.

20. The adjustable bed unit of claim 1, wherein said second yoke section extends relative to said first yoke section at a fixed angle of greater than ninety degrees.

21. The adjustable bed unit of claim 1, wherein said first yoke section is secured to said head section.

* * * * *